US007060666B2

(12) United States Patent
McHattie et al.

(10) Patent No.: US 7,060,666 B2
(45) Date of Patent: Jun. 13, 2006

(54) FABRIC CONDITIONING COMPOSITION

(75) Inventors: Gillian Sheila McHattie, Wirral (GB); Tom Matthew Salmon, Wirral (GB); Samantha Small, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/445,569

(22) Filed: May 27, 2003

(65) Prior Publication Data

US 2003/0220217 A1 Nov. 27, 2003

(30) Foreign Application Priority Data

May 27, 2002 (GB) ..... 0212157.2

(51) Int. Cl.
*C11D 1/835* (2006.01)

(52) U.S. Cl. ..... 510/466; 510/522; 510/527

(58) Field of Classification Search ..... 510/516, 510/522, 527, 466

See application file for complete search history.

(56) References Cited

U.S. PATENT DOCUMENTS

| | | | | |
|---|---|---|---|---|
| 4,337,166 | A | 6/1982 | Hill et al. | |
| 4,798,679 | A | 1/1989 | Castro et al. | |
| 4,961,753 | A | 10/1990 | Donkers et al. | |
| 5,057,240 | A * | 10/1991 | Madore et al. | 510/328 |
| 5,484,540 | A | 1/1996 | Hubesch | |
| 6,494,920 | B1 * | 12/2002 | Weuthen et al. | 8/137 |
| 2003/0050220 | A1 | 3/2003 | Trinh et al. | |

FOREIGN PATENT DOCUMENTS

| | | |
|---|---|---|
| EP | 0 200 325 B1 | 12/1986 |
| EP | 0 224 839 B1 | 6/1987 |
| EP | 0 228 261 A2 | 7/1987 |
| EP | 0 233 910 B1 | 9/1987 |
| EP | 0 255 711 A2 | 2/1988 |
| EP | 0 354 856 A2 | 2/1990 |
| GB | 2 159 547 A | 12/1985 |
| GB | 2 223 768 A | 4/1990 |
| WO | 95/24460 | 9/1995 |
| WO | 00/24851 A | 5/2000 |
| WO | 00/24860 | 5/2000 |
| WO | 01/60961 A1 | 8/2001 |
| WO | 01/73187 A2 | 10/2001 |
| WO | 02/16535 | 2/2002 |

OTHER PUBLICATIONS

UK Search Report No. GB 0212157.2 dated Oct. 24, 2002, 1 page.
UK Search Report No. GB 0212157.2 dated Feb. 18, 2003, 1 page.
International Search Report No. PCT/EP 03/04408 dated Aug. 5, 2003, 5 pp.

* cited by examiner

*Primary Examiner*—John R. Hardee
(74) *Attorney, Agent, or Firm*—Rimma Mitelman

(57) ABSTRACT

An aqueous fabric conditioning composition comprises a cationic softening agent and a silicone having a viscosity of from 1 to less than 10,000 cSt wherein the silicone comprises a cyclic polydi-($C_{1-6}$)alkyl siloxane. A silicone is used in a fabric conditioning composition comprising a cationic fabric softening agent to reduce the drying time of laundered fabrics and/or to increase the rate of water removed from the fabrics during the spin cycle of an automatic washing machine.

8 Claims, No Drawings

FABRIC CONDITIONING COMPOSITION

FIELD OF THE INVENTION

The present invention relates to a fabric conditioning composition and to the use of a composition to reduce the drying time of laundered fabrics.

BACKGROUND OF THE INVENTION

Fabric conditioners are known to provide benefits such as softening and perfume to fabrics. Typically, such compositions comprise a fabric softening agent dispersed in water. The fabric softening agent can be included at up to 8% by weight, in which case the compositions are considered dilute, or at levels from 8% to 60% by weight, in which case the compositions are considered concentrated.

More recently, it has been proposed to provide additional benefits from fabric conditioning compositions, such as ease of ironing or anti-wrinkle. This is beneficial since it can reduce the time spent by consumers on the laundry process.

WO 95/24460 discloses a rinse added fabric softening composition comprising from 0.2 to 20% of a silicone. The silicone has a linear structure.

EP-A2-0228261 relates to a product for relaxing fibres in textile fabrics comprising a silicone-glycol copolymer and 0.4 to 1.4 parts by weight of a quaternary ammonium salt.

GB-A-2159547 refers to a textile treating composition comprising a cationic surfactant and a polydiorganosiloxane having at least one amido-containing substituent. The siloxane imparts a dry non-greasy touch to fabrics and reduces rewet time.

EP-A2-0255711 discloses an article of manufacture for use in an automatic laundry dryer comprising a flexible substrate carrying (A) a cationic fabric softening agent and (B) 0.1 to 15 wt % of a polydiorganosiloxane. The siloxane is said to have a generally linear structure.

WO-A1-00/24860 discloses a product and process for laundering delicate or dry-clean only garments in a domestic washing machine. The product preferably includes a silicone softening agent. The silicone has a linear structure.

GB-A-2223768 relates to a rinse cycle softener comprising a polydiorganosiloxane foam controlling agent. The siloxane is substantially linear.

EP-A2-233910 discloses rapidly biodegradable fabric softening compositions where an optional silicone component may be present. The silicone is described as predominantly linear.

EP-A-354856 teaches fabric softening compositions comprising a cationic softening salt and a cross-linked polysiloxane.

The present inventors have now found that certain compositions can assist in reducing the drying time of laundered fabrics. Without being bound by theory, it is believed that the compositions decrease the amount of water left on fabrics following the rinse cycle spin. Thus, when the weight of the wet fabric is less, this will correspond to a shorter drying time for the consumer, irrespective of the method of drying.

This can not only reduce the time spent by consumers on such a task but can, for instance, reduce the energy requirement of tumble dryers which would not need to be run for as long.

EP-A1-224839 and EP-A1-200325 both disclose that silicone may be dispersed in rinse water combined with other laundry additives such as fabric conditioning compositions to reduce the drying time of fabrics. The silicones are amino- or amido-functional.

WO 01/73187 discloses a method for reducing the drying time of fabric comprising treating the fabric with a treatment composition comprising formaldehyde, a catalyst for crosslinking the formaldehyde with natural fibres in the fabric, and silicone elastomer or a precursor thereof, and heating the treated fabric to effect crosslinking of the formaldehyde. This is a complex operation which requires a heating stage to effect a chemical reaction within the components.

U.S. Pat. No. 4,337,166 discloses a fast-dry shampoo composition which contains cyclic methyl siloxanes.

WO-A1-01/60961 discloses laundry compositions containing superwetting silicones for enhanced penetration of active ingredients and anti-wrinkle benefits.

US-A1-2003/0050220 discloses articles for reducing the drying time of laundered fabrics, the articles comprising a fabric softening composition within a package and instructions to use an effective amount of the fabric softening composition to reduce the drying time of the fabrics. There is no disclosure of silicones.

In addition to providing the abovementioned benefits, it is highly desirable that the composition remains stable upon storage.

Instability can manifest itself as a thickening of the product upon storage, even to the point that the product is no longer pourable.

The problem of thickening upon storage is particularly apparent in concentrated fabric softening compositions comprising an ester-linked quaternary ammonium fabric softening material having one or more fully saturated alkyl chains.

It is also desirable that the compositions provide a drier tactile feel to fabrics

OBJECTS OF THE INVENTION

The present invention seeks to address one or more of the aforementioned problems and to provide one or more of the aforementioned benefits.

STATEMENT OF INVENTION

Thus, according to the present invention there is provided an aqueous fabric conditioning composition comprising (a) a cationic softening agent; and (b) a silicone having a viscosity of from 1 to less than 10,000 cSt wherein the silicone comprises a cyclic polydi-($C_{1-6}$)alkyl siloxane.

The invention further provides the use of a silicone in a fabric conditioning composition comprising a cationic fabric softening agent to reduce the drying time of laundered fabrics.

The invention also provides the use of a silicone in a fabric conditioning composition comprising a cationic fabric softening agent to remove water from laundered fabrics during the spin cycle of an automatic washing machine.

DETAILED DESCRIPTION OF THE INVENTION

In the context of the present invention, the term "comprising" denotes that the feature(s) to which it refers is/are not exhaustive and further features may be present.

Cationic Fabric Softener

The cationic softener is preferably a quaternary ammonium fabric softening material.

Particularly preferred quaternary ammonium fabric softening materials comprise two $C_{12-28}$ alkyl or alkenyl groups connected to the nitrogen head group, preferably via at least one ester link. It is more preferred if the quaternary ammonium material has two ester links present.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear, although a degree of branching, especially mid-chain branching, is within the scope of the invention.

The first group of cationic fabric softening compounds suitable for use in the invention is represented by formula (I):

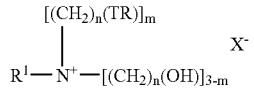

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group,

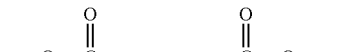

T is n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Especially preferred materials within this group are dialkenyl esters of triethanol ammonium methyl sulphate. Commercial examples include Tetranyl AHT-1 (di-hardened tallow ester of triethanol ammonium methyl sulphate 85% active in 15% IPA), AT-1(di-oleic ester of triethanol ammonium methyl sulphate 90% active), L5/90 (palm ester of triethanol ammonium methyl sulphate 90% active), all ex Kao, and Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation.

The second group of cationic fabric softening compounds suitable for use in the invention is represented by formula (II):

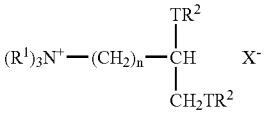

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

Preferred materials of this class such as 1,2 bis[tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein.

A third group of cationic fabric softening compounds suitable for use in the invention is represented by formula (III):

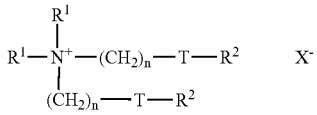

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

A fourth group of cationic fabric softening compounds suitable for use in the invention is represented by formula (IV):

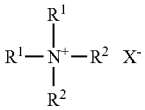

(IV)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above.

Iodine Value of the Parent Fatty Acyl Group or Acid

The iodine value of the parent fatty acyl compound or acid from which the cationic softening material is formed is from 0 to 140, preferably from 0 to 100, more preferably from 0 to 60.

It is especially preferred that the iodine value of the parent compound is from 0 to 20, more preferably 0 to 9, most preferably 0 to 4, e.g. 2 or less or even 1.5 or less. Where the iodine value is 4 or less, the softening material provide's excellent softening results and has improved resistance to oxidation and associated odour problems upon storage.

When unsaturated hydrocarbyl chains are present, it is preferred that the cis:trans weight ratio of the material is 50:50 or more, more preferably 60:40 or more, most preferably 70:30 or more, e.g. 85:15 or more.

The iodine value of the parent fatty acid or acyl compound is measured according to the method set out in WO-A1-01/46513.

The softening material is preferably present in an amount of from 1 to 60% by weight of the total composition, more preferably from 2 to 40%, most preferably from 3 to 30% by weight.

Silicone

The silicone for use in the present invention comprises a cyclic polydi-($C_{1-6}$)alkyl siloxane.

Typical silicones of this class have the general formula $R_aSiO_{(4-a)/2}$ wherein each R is the same or different and is selected from hydrocarbon and hydroxyl groups, 'a' being from 0 to 3. In the bulk material, 'a' typically has an average value of from 1.85–2.2.

The silicone is preferably comprised of a homopolymer. Preferably the silicone is free of cross-linking. It is further preferred that the silicone is free of amine or amide linkages.

It has been found that cyclic silicones deliver excellent faster drying characteristics to fabrics and are thus preferred to linear or generally linear silicones.

A particularly preferred silicone comprises a cyclic poly-dimethyl-siloxane.

Suitable commercially available silicones include DC245 (polydimethylcyclopentasiloxane also known as D5), DC246 (polydimethylcyclohexasiloxane also known as D6), DC1184 (a pre-emulsified polydimethylpentasiloxane also known as L5) and DC347 (a pre-emulsified 100 cSt PDMS fluid), all ex Dow Corning.

Silicone Form

The silicone may be received and incorporated into the composition either directly as an oil or pre-emulsified.

Pre-emulsification is typically required when the silicone is of a more viscous nature.

Suitable emulsifiers include cationic emulsifiers, nonionic emulsifiers or mixtures thereof.

Silicone Viscosity

The reference to the viscosity of the silicone denotes either the viscosity before emulsification when the silicone is provided as an emulsion for incorporation into the fabric conditioning composition or the viscosity of the silicone itself when provided as an oil for incorporation into the fabric conditioning composition.

The silicone preferably has a viscosity (as measured on a Brookfield RV4 viscometer at 25° C. using spindle No. 4 at 100 rpm) of from 1 cSt to less than 10,000 cSt (centi-Stokes), preferably from 1 cSt to 5,000 cSt, more preferably from 2 cSt to 1,000 cSt and most preferably 2 cSt to 100 cSt.

It has been found that drying time can be reduced using silicones having a viscosity of from 1 to 500,000 cSt.

However, significantly improved results are obtained when the viscosity is from 1 to less than 10,000 cSt.

The silicone is preferably present at a level of from 0.5 to 20%, more preferably from 1 to 12%, most preferably from 1 to 8% by weight of active ingredient, based on the total weight of the composition.

Fatty Alcohol—Co-Active Softener

Optionally and advantageously, one or more un-alkoxylated fatty alcohols are present in the composition.

Preferred alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferred as these have been found to deliver greater benefits in terms of stability, especially low temperature stability.

Suitable commercially available fatty alcohols include hardened tallow alcohol (available as Hydrenol S3, ex Sidobre Sinnova, and Laurex CS, ex Clariant).

The fatty alcohol content in the compositions is from 0 to 10% by weight, more preferably from 0.005 to 5% by weight, most preferably from 0.01 to 3% by weight, based on the total weight of the composition.

It is particularly preferred that a fatty alcohol is present if the composition is concentrated, that is if more than 8% by weight of the cationic softening agent is present in the composition.

Other Co-Active Softeners

Co-active softeners for the cationic surfactant may also be incorporated in an amount from 0.01 to 20% by weight, more preferably 0.05 to 10%, based on the total weight of the composition. Preferred co-active softeners include fatty esters, and fatty N-oxides.

Preferred fatty esters include fatty monoesters, such as glycerol monostearate (hereinafter referred to as "GMS"). If GMS is present, then it is preferred that the level of GMS in the composition is from 0.01 to 10% by weight, based on the total weight of the composition.

The co-active softener may also comprise an oily sugar derivative. Suitable oily sugar derivatives, their methods of manufacture and their preferred amounts are described in WO-A1-01/46361 on page 5 line 16 to page 11 line 20, the disclosure of which is incorporated herein.

Nonionic Surfactant

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the alkoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is preferably from 8 to 40, more preferably from 10 to 30, most preferably from 11 to 25, e.g. 12 to 22.

The level of alkoxylation, Z, denotes the average number of alkoxy groups per molecule.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO (18), and tallow alcohol-EO (25), coco alcohol-EO(10), coco alcohol-EO(15), coco alcohol-EO(20) and coco alcohol-EO(25)

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is preferably present in an amount of from 0.01 to 10%, more preferably 0.1 to 5%, most preferably 0.35 to 3.5%, e.g. 0.5 to 2% by weight, based on the total weight of the composition.

Perfume

The compositions of the invention preferably comprise one or more perfumes in order to provide an odour desirable to consumers.

It is well known that perfume is typically provided as a mixture of components. Suitable components for use in the perfume include those described in "Perfume and Flavor Chemicals (Aroma Chemicals) by Steffen Arctander, published by the author 1969 Montclait, N.J. (US), reprinted 1 Apr. 1982 library of Congress Catalog Number 75-91398, incorporated herein.

Furthermore, it is preferred that the perfume comprises substantive perfume ingredients as described in US-A1-2003/0050220 paragraphs 60 to 72, incorporated herein.

The perfume is preferably present in an amount from 0.01 to 10% by weight, more preferably 0.05 to 5% by weight, most preferably 0.5 to 4.0% by weight, based on the total weight of the composition.

Liquid Carrier

The liquid carrier employed in the instant compositions is at least partly water due to its low cost relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and a low molecular weight, e.g. <100, organic solvent, e.g. a lower alcohol such as ethanol, propanol, isopropanol or butanol are useful as the carrier liquid. Low molecular weight alcohols including monohydric, dihydric (glycol, etc.) trihydric (glycerol, etc.), and polyhydric (polyols) alcohols are also suitable carriers for use in the compositions of the present invention.

Polymeric Viscosity Control Agents

It is useful, though not essential, if the compositions comprise one or more polymeric viscosity control agents. Suitable polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

Nonionic and/or cationic polymers are preferably present in an amount of 0.01 to 5 wt %, more preferably 0.02 to 4 wt %, based on the total weight of the composition.

Further Optional Ingredients

Other optional nonionic softeners, bactericides, soil-releases agents may also be incorporated in the compositions of the invention.

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, antioxidants, sunscreens, anti-corrosion agents, drape imparting agents, preservatives, anti-static agents, ironing aids and dyes.

Product Form

The product may be a liquid or solid. Preferably the product is a liquid which, in its undiluted state at ambient temperature, comprises an aqueous liquid, preferably an aqueous dispersion of the cationic softening material.

Product Use

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

EXAMPLES

The invention will now be illustrated by the following non-limiting examples. Further modifications will be apparent to the person skilled in the art.

Samples of the invention are represented by a number. Comparative samples are represented by a letter.

All values are % by weight of the active ingredient unless stated otherwise.

The samples comprising silicone were prepared by admixing the silicone oil or silicone emulsion into the pre-prepared fabric conditioner base product under ambient conditions. In order to ensure homogeneity of the product, milling was carried out during and after admixing the silicone as required.

TABLE 1

| Sample | A | 1 | 2 | 3 | 4 | 5 | 6 | 7 | B | 8 |
|---|---|---|---|---|---|---|---|---|---|---|
| Ester Quat (1) | 13 | 11.4 | 11.4 | 11.4 | 11.4 | 11.4 | 5.0 | 5.0 | 5.0 | 5.0 |
| Nonionic (2) | 0.45 | 0.30 | 0.3 | 0.3 | 0.3 | 0.3 | 0.10 | 0.10 | 0.10 | 0.10 |
| Fatty Alcohol (3) | 0.6 | 1.6 | 1.6 | 1.6 | 1.6 | 1.6 | 0.4 | 0.4 | 0.4 | 0.4 |
| Silicone (4)* | — | 8.33 | — | — | — | — | 2.78 | — | — | — |
| Silicone (5)* | — | — | 5.0 | 3.5 | — | — | — | — | — | — |
| Silicone (6)* | — | — | — | — | 8.33 | — | — | 2.78 | — | — |
| Silicone (7)* | — | — | — | — | — | 5.0 | — | — | — | 1.67 |
| Minors (8) | ← Trace → | | | | | | | | | |
| Thickener (9) | — | — | — | — | — | — | ← Trace → | | | |
| Water | ← To 100 → | | | | | | | | | |

(1) Tetranyl AHT-1 (di-hardened tallow ester of triethanol ammonium methyl sulphate, ex Kao)
(2) Coco 20EO Nonionic (Genapol C200, ex Clariant)
(3) Laurex CS (Hardened tallow alcohol, ex Clariant)
(4) DC1274 (provided as a 60% active emulsion of 60,000 cSt PDMS, ex Dow Corning)
(5) DC246 D6 volatile silicone (100% active, ex Dow Corning)
(6) DC347 (provided as a 60% active emulsion of 100 cSt PDMS, ex Dow Corning)
(7) DC245 D5 volatile silicone (100% active, ex Dow Corning)
(8) antifoam, dye, preservative and perfume
(9) Natrosol Plus (hydrophobically modified cellulose ether, ex Hercules)
*denotes amount of raw material present

Example 1

Evaluation of Water Retention 1.5 Kg loads of desized Terry Towelling (40×60 cm) were weighed and placed in a Miele W833 washing machine. The loads were then washed on a 40° C. cotton cycle using 108 g of Non-Bio Persil (tradename) and were spun at 900 rpm. In the rinse cycle, 35 g of each of the concentrated samples (i.e. having 8 wt % or more cationic softening agent) or 100 g of the dilute samples (i.e. having less than 8 wt % of the cationic softening agent) was used.

As soon as the wash was completed the fabric monitors were re-weighed.

Water retention at this stage was calculated using the following equation:

$$\text{\% water retention of fabric} = 100 \times \left( \frac{(\text{wet weight} - \text{dry weight})}{\text{dry weight}} \right)$$

For each sample, the test was replicated and the result averaged.

TABLE 2

| Sample | Mean % water retention |
|---|---|
| Water rinse | 62.76 |
| A | 54.24 |
| 1 | 52.90 |
| 2 | 50.34 |

TABLE 3

| Sample | Mean % water retention |
|---|---|
| A | 52.46 |
| 1 | 52.78 |
| 3 | 50.72 |
| 2 | 51.00 |
| 4 | 51.34 |
| 5 | 50.62 |

TABLE 4

| Sample | Mean % water retention |
|---|---|
| Water rinse | 60.07 |
| B | 53.47 |
| 7 | 50.54 |
| 8 | 52.21 |

TABLE 5

| Sample | Mean % water retention |
|---|---|
| Water rinse | 64.68 |
| A | 55.18 |
| 1 | 54.54 |
| 4 | 53.17 |

TABLE 6

| Sample | Mean % water retention |
|---|---|
| B | 45.8 |
| 8 | 44.4 |

Example 2

Tactile Evaluation

The loads were washed as above. For each sample, 2 replicate washes were carried out and the average value taken.

Tactile evaluation was made by paired comparison of a test sample against a standard concentrate fabric conditioner control.

For each sample, the damp monitors were weighed and the mean % water retention calculated according to the equation above. The wash loads were then split in half with half the monitors placed in a laundry basket and half on clothes airers to dry. Teams of 10 or 15 trained tactile panellists assessed the damp monitors in the basket in order to rate comparative dryness. Each panellist assessed 2 pairs. The other monitors were dried until they contained about 10% water, placed in the laundry basket and assessed in the same way as the damp monitors.

The results are given in the following table.

TABLE 7

| Test | Sample | Mean % water retention | Tactile results (damp) - Number of panellists choosing sample as drier | Tactile results (partially dry) - Number of panellists choosing sample as drier |
|---|---|---|---|---|
| 1 | A | 51.9 | 4/20 | 6/20 |
| | 5 | 49.3 | 16/20 | 14/20 |
| 2 | A | 55.06 | 8/20 | 1/20 |
| | 9* | 51.44 | 12/20 | 19/20 |
| 3 | A | 65.2 | 16/30 | 6/30 |
| | 1 | 62.9 | 14/30 | 24/30 |
| 4 | B | 64.8 | 9/30 | 7/30 |
| | 6 | 63.5 | 21/30 | 23/30 |

*sample 9 is identical to sample 1 above except that the silicone raw material is present at 8.47% (of which 5% is active ingredient) and the silicone before emulsification has a viscosity of 2000 cSt.

The invention claimed is:

1. An aqueous fabric conditioning composition comprising (a) a cationic softening agent comprising a quaternary ammonium material represented by formula (I):

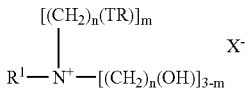

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group,

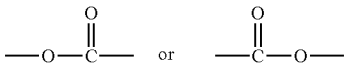

T is n is 0 or a number selected from 1 to 4, m is 1, 2 or 3 and denotes the number of moieties to which it relates that pend directly from the N atom, and $X^-$ is an anionic group;

wherein the parent fatty acid or acyl group of the quaternary ammonium material has an iodine value of from 0 to 4; and (b) from 1 to 12% of a silicone comprising a cyclic polydimethyl siloxane having a viscosity of from 1 to less than 5,000 cSt.

2. A fabric conditioning composition as claimed in claim 1 wherein the silicone has a viscosity of from 2 cSt to 1,000 cSt.

3. A method of reducing the drying time of laundered fabrics comprising using a silicone in a fabric conditioning composition comprising:

(a) providing an aqueous fabric conditioning composition comprising cationic fabric softening agent as claimed in claim 1; and (b) contacting the fabrics with said composition.

4. A method according to claim 3 wherein the silicone comprises a non-emulsified silicone having a viscosity of from 1 to less than about 5,000 cSt.

5. A method according to claim 3 wherein the silicone is pre-emulsified before incorporation into the fabric conditioning composition and has a viscosity before emulsification of from 1 to less than about 5,000 cSt.

6. A method of removing water from laundered fabrics during the spin cycle of an automatic washing machine comprising using silicone in a fabric conditioning composition comprising:

(a) providing an aqueous fabric conditioning composition comprising cationic fabric softening agent as claimed in claim 1; and (b) contacting the fabrics with said composition.

7. The aqueous fabric conditioning composition as claimed in claim 1, wherein $X^-$ is selected from the group consisting of chloride, methyl sulphate, ethyl sulphate and combinations thereof.

8. The fabric conditioning composition as claimed in claim 1 wherein the silicone is poly-dimethyl-siloxane having a viscosity before emulsification of about 2,000 cSt.

* * * * *